United States Patent [19]

Leinweber et al.

[11] 4,020,309

[45] Apr. 26, 1977

[54] PUSHBUTTON SWITCH/ANNUNCIATOR FOR AIRCRAFT INSTRUMENTS

[75] Inventors: Donald Harder Leinweber; Thomas Walter Neis, both of Phoenix, Ariz.

[73] Assignee: Sperry Rand Corporation, New York, N.Y.

[22] Filed: Oct. 20, 1975

[21] Appl. No.: 624,160

[52] U.S. Cl. ..... 200/314; 116/124 L

[51] Int. Cl.[2] ..... H01H 9/00

[58] Field of Search ..... 200/308–317, 200/78; 240/1 EL, 2.1; 340/27 R, 27 AT, 27 NA, 27 SS; 116/124 L, 129 P

[56] References Cited

UNITED STATES PATENTS

| | | | |
|---|---|---|---|
| 601,276 | 3/1898 | Platt | 200/308 |
| 3,029,334 | 4/1962 | Anderson et al. | 240/1 EL |

*Primary Examiner*—Robert K. Schaefer
*Assistant Examiner*—Morris Ginsburg
*Attorney, Agent, or Firm*—Howard P. Terry

[57] ABSTRACT

The invention comprises apparatus for performing a switching function in aircraft display instruments for providing a high contrast annunciation or indication thereof having a pair of transversal members disposed such that the depression of one of the members causes the rocker arm of a rocker switch engaged therewith to actuate according to the respective member. A linking member pivotally coupled between the two transversal members rotates through a fixed angle in response to the opposing movements of the transversal members causing a pivotally fastened indicator member with which it communicates to rotate such that a portion of the indicator member is rotated toward the face of the display instrument and provides an appropriate annunciation of the switch status.

6 Claims, 2 Drawing Figures

PUSHBUTTON SWITCH/ANNUNCIATOR FOR AIRCRAFT INSTRUMENTS

BACKGROUND OF THE INVENTION

1. Field of the Invention

The invention relates to switching mechanisms with associated annunciation and in particular to a pushbutton switch/annunciator for use in aircraft instruments such as, for example, an aircraft horizontal situation indicator for switching and annunciating the source of navigational information being displayed thereon.

2. Description of the Prior Art

Prior art devices used in aircraft instruments typically involve the use of power consuming apparatus to perform the annunciation of selected data or functions. In particular, prior art apparatus required the use of electromechanical devices, such as solenoid-operated flags, etc. which require additional space and electrical wiring, consume electrical power and add considerably to the cost of the device. Moreover, additional lighting sources are often required to illuminate the annunciator thereby further increasing the power consumption and the cost of the device.

SUMMARY OF THE INVENTION

The apparatus of the present invention eliminates all of the foregoing and provides an economical pushbutton switch/annunciator assembly.

In the present invention, a pushbutton or first transversal assembly is actuated which depresses or actuates the rocker arm of the rocker type data or function select switch. The opposite end of the rocker arm acts against a second transversal assembly, generally parallel with respect to the first transversal assembly, forcing it in the opposite direction. A linking or lever assembly which is loosely coupled between the two transversal assemblies rotates as a result of the respective movements of the transversal assemblies causing a pivotally mounted indicator member with which it communicates to rotate. The indicator assembly is disposed and constructed such that a first flag having a reflective surface thereon is caused to move directly behind a legend engraved through an opaque mask and situated above the depressed pushbutton thereby annunciating the status of the switch. A second flag, associated with the other pushbutton or transversal assembly, is simultaneously removed a substantial distance from a second engraved legend on the mask so that its reflective surface cannot be seen through the engraved legend. Similarly, the opposite results will occur for a depression of the second transversal assembly.

The present invention in addition to eliminating the costly electromechanical apparatus of the prior art provides a high contrast annunciator required in an airborne environment due to the large travel distance of the flags as compared with the actual pushbutton travel distance. The descriptive legends in the mask associated with the two pushbutton or transversal assemblies, respectively, may also be located directly thereabove thereby eliminating any confusion as to the status of the switch. Additionally, there is no wiring required by the apparatus since no electrical power is required to operate the switch or the annunciator and any lighting required by the apparatus is provided by a wedge lighting arrangement which illuminates the entire face of the aircraft instrument.

DESCRIPTION OF THE PREFERRED EMBODIMENT

Figure 1:
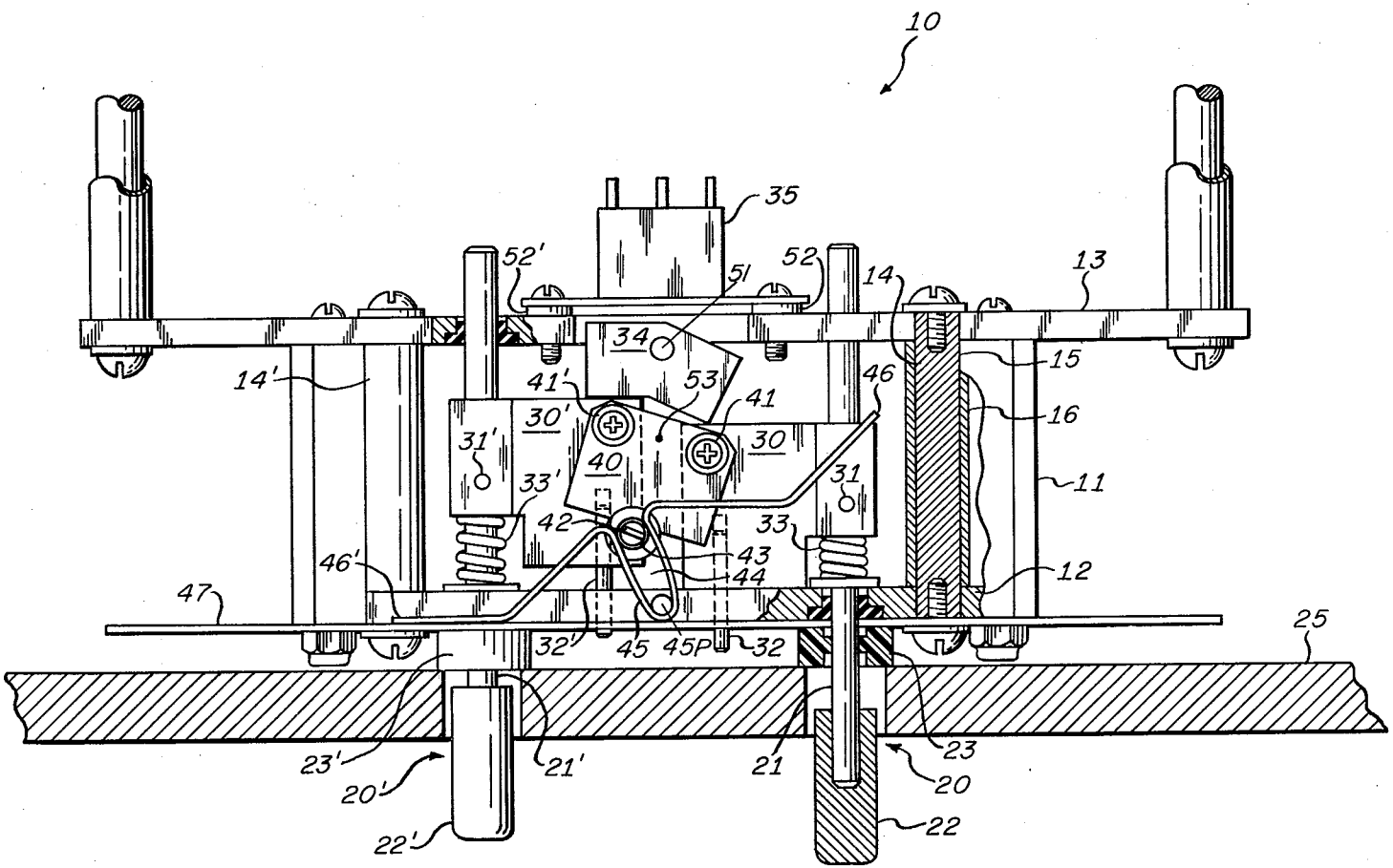
FIG. 1 is a fragmentary top view of the front portion of an aircraft instrument illustrating the apparatus comprising the present invention.

Referring now to FIg. 1, a top view of the apparatus comprising the switch/annunciator apparatus 10 of the present invention is illustrated. A main frame 11 for the switch/annunciator assembly is comprised of a front plate 12 and a rear plate 13 separated by means of support rods 14 and 14' each comprised of a post 15 and spacer 16 and fastened to the front and rear plates, respectively, by means of screws.

A pair of pushbutton or transversal assemblies 20 and 20' are slidably supported by the front and rear plates 12 and 13, respectively. Each transversal assembly is comprised of a shaft 21 and 21', respectively, having one end protruding from the rear plate 13, the other end protruding from the front plate 12 and slidably supported thereby. Each transversal assembly 20 and 20' further includes a pushbutton 22 and 22', respectively, secured to the outer section of the appropriate shaft 21 or 21', i.e., the end protruding from the front plate 12. The pushbuttons 22 and 22' protrude through an instrument bezel 25 through suitable cavities which are sealed by seals 23 and 23' to fully close the interior of the instrument. The shafts 21 and 21' of each transversal assembly extend through a block 30 and 30', respectively within the inner section of the frame 11, i.e., between the front and rear plates 12 and 13, respectively, and each is secured to its respective shaft preferably by means of a press fit pin 31, 31' extending therethrough. Each block 30 and 30' of each transversal assembly is also supported by a guide pin 32 and 32', respectively, secured thereto and slidably supported by the front plate 12 of the frame 11 in order to prevent any twisting of the shafts 21 and 21'. The blocks are generally rectangular with the exception of a slot cut from the corner thereof to accommodate springs 33 and 33'. The rear surfaces of the stops of each transversal assembly coupled with or abut the rocker arm 34 of a switch 35, preferably a conventional rocker switch, fastened to the rear plate 13 of the frame 11.

A linking assembly or lever 40, preferably comprised of a flat plate, is loosely coupled between each of the blocks 30 and 30' by means of two fastening assemblies 41 and 41', each comprised of a nylon or teflon bushing and the screw. The holes in plate 40 which accommodate the fastening assemblies 41 and 41' preferably are elongated in order to accommodate the rotational movement of the lever in operation, as will be described hereinafter. The front of the lever 40 is an upturned tap or tang 42 over which is snugly fit a nylon or teflon bushing which communicates with the indicator member 45. Indicator member 45 comprises a thin strip of rigid material, such as brass, bent into the general shape of a W. The central portion of the indicator member 45 is pivotally supported by a pin 45p on the front plate 12 such that the channel 44 formed therein embraces the tang bushing 43. The ends of the W shaped indicator member 45 extend outwardly therefrom to form two fin-like extensions or flags 46 and 46'. As shown in FIG. 1, the indicator member 45 is arranged relative to the distance between its pivot point on front plate 12 and the tang bushing 43, such that at each extreme of its rotational movement or actuation, as will be described, one of the flags is situated directly against the rear surface of the instrument dial mask 47 and the other is substantially displaced therefrom.

Figure 2:
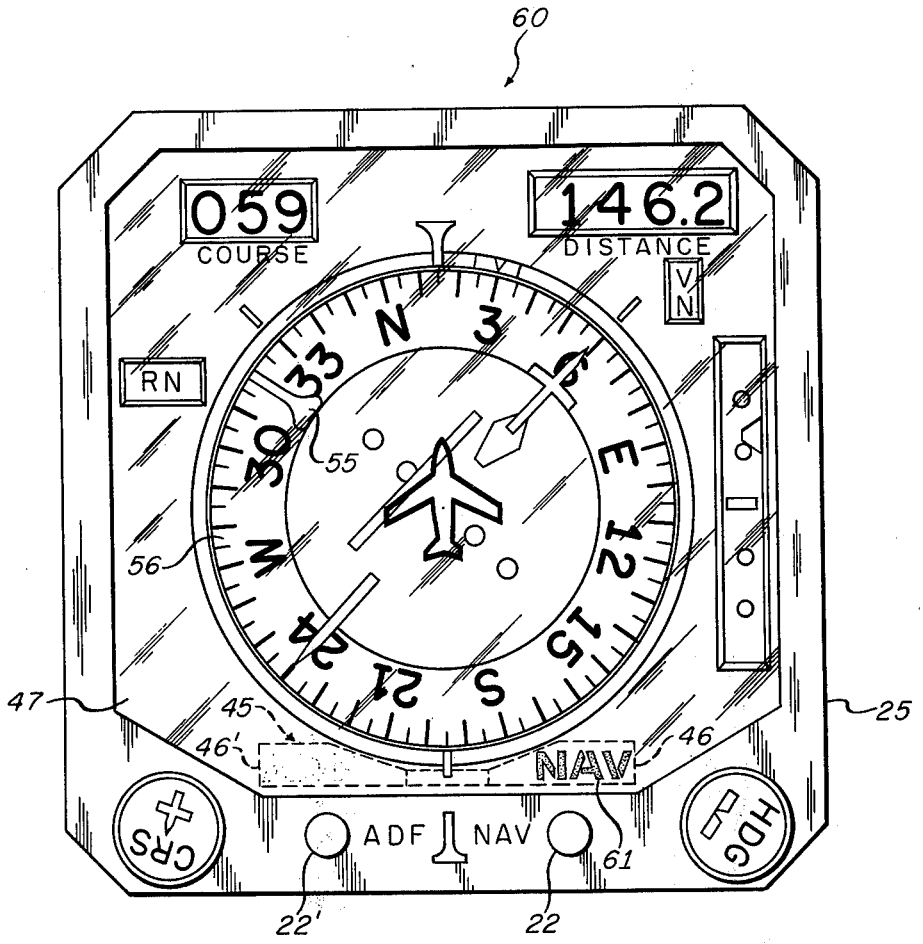
FIG. 2 is a drawing illustrating the face of an aircraft instrument, specifically, a horizontal situation indicator, utilizing the present invention.

In the illustrated embodiment of the present invention, incorporated in an otherwise conventional horizontal situation indicator (HSI) as depicted in FIG. 2, the pilot of the aircraft may select between two sources of radio navigation data, such as ADF (Automatic Direction Finder) or NAV (VOR Navigation). The bearing of the craft from this data is displayed by the position of pointer 55 relative to the compass dial 56. The selection and annunciation of such data is provided by the present invention as will now be described.

Initially, the pilot may select or depress one of the pushbuttons 22 or 22' (NAV or ADF, respectively). If, for example, the pilot depresses pushbutton 22, an ingression of transversal assembly 20 will result. Accordingly, the block 30 is moved toward the rear plate 13 thereby rotating rocker arm 34 about its pivot point 51. The rotation of rocker arm 34, in addition to actuating the switch 35, reacts upon the rear surface of block 30' causing an egression of transversal assembly 20'. Thus, depressing pushbutton 22 causes pushbutton 22' to move outwardly from the bezel 25 while depressing pushbutton 22' has a similar effect on pushbutton 22'.

The switch is fastened to the rear plate 13 of frame 11 by means of screws and shims 52 and 52'. The width of the shims 52 and 52' are selected so as to insure the proper alignment of the flags 46 and 46' with the mask 47. With the rocker arm 34 in the position illustrated in FIG. 1, shim 52 is selected so that the right side of the rocker arm 34 makes contact with the rear surface of the block 30 when it is in contact with or abuts the rear surface of the front plate 12. Similarly, the width of shim 52' is selected such that, for the rocker arm in the opposite position to that shown in FIG. 1, the rocker arm 34 makes contact with the rear surface of stop 30' when stop 30' abuts the rear surface of front plate 12.

An ingression of transversal member 20 along with the accompanying egression of transversal member 20' and an ingression of transversal assembly 20' along with the accompanying egression of transversal assembly 20 effectively causes the linking assembly or lever 40 to rotate about its virtual pivot point 53. It can be appreciated that, since the linking assembly 40 rotates about its virtual pivot point 53, the length of the arc travelled by the tang 42 and nylon bushing 43 is determined by both the angle of rotation of the link 40 and the distance between the pivot point 53 and the tang 42.

The indicator assembly 45 is preferably formed from a piece of flat stock bent at the middle to form channel 44 as above-described. Additionally, each fin-like projection or flag 46 or 46' may have a bend therein in order to assure a flush contact thereof with the rear surface of the mask 47. Referring back to the original example given above wherein pushbutton 22 is depressed, it can be appreciated that the link 40 in response to the depression of pushbutton 22 will rotate counterclockwise through the aforementioned fixed angle. Since the tang 42 and bushing 43 upwardly projecting from linking assembly 40 extend into the channel 44 of indicator member 45, the counterclockwise rotation of linking assembly 40 will cause a clockwise rotation of indicator member 45 until the flag 46 abuts or rests against the rear surface of the mask 47. Simultaneously, flag 46' is rotated a substantial distance from the rear surface of the mask 47.

The mask 47 in the instrument face is opaque having descriptive legends such as ADF and NAV cut or engraved therethrough in the region directly above the pushbuttons 22 and 22'. A light-reflective, contrasting background such as white paint is provided on the surface of the flags 46 and 46' which contacts the rear surface of the mask 47 thus providing an appropriate indication or annunciation of the position of the switch, i.e., the source of the data being presented to the pilot. Similarly, a light reflective, contrasting background is provided on flag 46' thereby giving the appropriate indication when pushbutton 22' is depressed.

The indications given by the apparatus of the present invention may be accomplished in a number of ways. As previously indicated, a generally opaque and preferably black mask may have cut outs therein in the form of letters and/or numbers in the vicinities of the respective pushbuttons. The mask may also be formed of a transparent material with a dull black finish applied to all of the rear surface thereof with the exception of the data or legends to be indicated. In both instances, the flags 46 and 46' are provided with a white reflective surface thereby providing a contrasting background for the legends cut out or formed on the transparent material, respectively. Additionally, the mask may have a rectangular cut out or transparency therein in which case the flags 46 and 46' are provided with the white reflective backgrounds on which is deposited the appropriate descriptive legends. As an example of the foregoing, FIG. 2 illustrates a typical horizontal situation indicator (HSI) 60 utilizing the present invention. Specifically, a black opaque mask 47 with the appropriate descriptive legends are cut therefrom is utilized in conjunction with white reflective surfaces deposited on flags 46 and 46' of indicator assembly 45. In FIG. 2, a NAV indication 61 is given in response to the depression of pushbutton 22.

During aircraft operations when the ambient cockpit lighting may be inadequate, the present invention is very advantageous since the annunciation is located in the instrument face where it is illuminated by the integral wedge lighting provided for the instrument. More particularly, such wedge lighting may be of the type described in U.S. Pat. No. 3,029,334 entitled "Illuminating Means for Direct Reading Instruments" and assigned to the assignee of the present invention. As disclosed in that patent, the instrument bezel glass is comprised of transparent material and so shaped and constructed that light entering from an edge thereof is transmitted therethrough and uniformly illuminates the entire instrument face. Moreover, other forms of wedge lighting may also be employed.

It can therefore be appreciated that the present invention is an economical pushbutton switch/annunciator for aircraft instruments. In addition to eliminating the electromechanical apparatus of the prior art and all the associated wiring thereto, the present invention provides a high contrast, highly reliable annunciation of the switch functions by virtue of the large travel distance of the flags as compared to the small travel distance of the pushbuttons. The present invention also eliminates the need for separate lighting of the annunciator since it is being illuminated with the existing integral wedge lighting arrangement. Additionally, the present invention provides a certain amount of freedom with respect to the placement of the descriptive legends in the mask thereby eliminating any confusion as to the status of the switch.

While the invention has been described in its preferred embodiments, it is understood that the words which have been used are words of description rather than of limitation and that changes within the purview of the appended claims may be made without departing from the true scope and spirit of the invention in its broader aspects.

We claim:

1. In an aircraft instrument having an instrument face visible to the pilot of craft, apparatus for performing a desired switching function and providing a high contrast indication thereof comprising, a supporting frame, a first transversal member slidably supported by said frame and having an inner section within the apparatus and an outer section accessible to the pilot of the craft and extending from the face of said aircraft instrument, a second transversal member slidably supported by said frame and having an inner section within the apparatus and an outer section accessible to the pilot of the craft extending from the face of said aircraft instrument, switching means mounted to the frame forming a part of said apparatus having an actuating member pivotally secured thereto and coupled with the inner sections of said first and second transversal members such that with respect to the face of the aircraft instrument an ingression of said first transversal member results in an egression of said second transversal member and an ingression of said second transversal member results in an egression of said first transversal member and wherein said actuating member in response to the ingressions of said first and second transversal members actuates and restores respectively said switching means, linking means coupled between said first and second transversal members such that in response to an ingression of said first transversal member said linking means rotates through a fixed angle and, similarly, in response to an ingression of said second transversal member said linking means rotates through an equal and opposite angle, generally opaque display means disposed in the face of said instrument and visible to the pilot of the craft having a first and second transparency therethrough for indicating to the pilot the status of said first and second transversal members respectively with regard to said switching means, and indicator means pivotally mounted to said frame having first and second flag members extending therefrom, said flag members having contrasting backgrounds thereon with respect to said first and second transparency and wherein said indicator means communicates with said linking means in a manner such that for an ingression of said first transversal member said first flag member is disposed immediately behind said first transparency providing a contrasting background therefor and simultaneously disposing said second flag member a substantial distance from said second transparency and, similarly, for an ingression of said second transversal member said second flag member is disposed immediately behind said second transparency providing a contrasting background therefor and simultaneously disposing said first flag member a substantial distance from said first transparency.

2. The apparatus as set forth in claim 1 further including a first pushbutton secured to the outer section of said first transversal member for facilitating a desired ingression thereof, and a second pushbutton secured to the outer section of said second transversal member for facilitating a desired ingression thereof.

3. The apparatus as set forth in claim 1 wherein said switching means includes a rocker switch.

4. The apparatus as set forth in claim 1 wherein said first and said second transparency include descriptive legends formed in said opaque display means.

5. The apparatus as set forth in claim 1 wherein said display means includes a transparent material coated with an opaque substance and wherein said first and second transparency are formed by uncoated areas thereon in the form of descriptive legends.

6. The apparatus as set forth in claim 1 wherein said indicator means includes an arcuate member having a channel form therein with the head of said channel being pivotally connected to said frame, wherein the flag members extend from said channel, and wherein a portion of said linking means extends into said channel whereby said indicator means rotates responsive to the respective ingression of said first and said second transversal members.

* * * * *